US007774904B2

(12) United States Patent
Schmitz et al.

(10) Patent No.: US 7,774,904 B2
(45) **Date of Patent: *Aug. 17, 2010**

(54) APPARATUS IN SPINNING PREPARATION FOR SEPARATING FOREIGN OBJECTS AT A HIGH-SPEED ROLL FOR OPENING OR DOFFING FIBRE MATERIAL

(75) Inventors: Jörg Schmitz, Linnich (DE); Konrad Temburg, Mönchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 268 days.

This patent is subject to a terminal disclaimer.

(21) Appl. No.: 12/010,545

(22) Filed: Jan. 25, 2008

(65) Prior Publication Data

US 2008/0178431 A1 Jul. 31, 2008

(30) Foreign Application Priority Data

Jan. 26, 2007 (DE) ..... 10 2007 005 047

(51) Int. Cl.
*D02J 7/00* (2006.01)

(52) U.S. Cl. ..... 19/200

(58) Field of Classification Search ..... 19/200, 19/205; 57/304; 15/415.1, 416
See application file for complete search history.

(56) References Cited

U.S. PATENT DOCUMENTS

| | | | | |
|---|---|---|---|---|
| 4,153,978 | A | 5/1979 | Bangert | |
| 4,962,638 | A * | 10/1990 | Lane | 57/301 |
| 6,202,259 | B1 * | 3/2001 | Burr et al. | 19/145 |
| 6,298,522 | B1 * | 10/2001 | Rubenach | 19/204 |
| 2008/0178432 | A1 * | 7/2008 | Schmitz et al. | 19/296 |

FOREIGN PATENT DOCUMENTS

| | | | |
|---|---|---|---|
| DE | 296 04 552 | U1 | 7/1996 |
| DE | 196 45 844 | A1 | 5/1998 |
| DE | 198 06 891 | A1 | 8/1999 |
| DE | 100 22 734 | A1 | 11/2001 |
| DE | 699 12 110 | T2 | 7/2004 |
| DE | 10 2005 005 463 | A1 | 8/2006 |

(Continued)

OTHER PUBLICATIONS

German Search Report dated Jan. 26, 2007 issued in priority application No. DE 102007005047.1.

(Continued)

*Primary Examiner*—Shaun R Hurley
(74) *Attorney, Agent, or Firm*—Venable LLP; Robert Kinberg; Leigh D. Thelen

(57) ABSTRACT

In an apparatus in spinning preparation for separating foreign objects at a roll for opening or doffing fiber material, at least one device for separating the foreign objects is associated with a face of the roll. That device comprises an arrangement for producing a current of blast air flowing onto the face for detaching the foreign objects and carrying them away. The arrangement comprises a plurality of blast nozzles arranged across the width of the roll. To permit separation and allow rapid changes of the action of the blast air current, a bar for mounting the blast nozzles is present and the outlet of the blast nozzles is locally displaceable in relation to the face of the roll.

22 Claims, 6 Drawing Sheets

FOREIGN PATENT DOCUMENTS

| | | | | |
|---|---|---|---|---|
| EP | 1 354 988 | A1 | | 0/2003 |
| GB | 2 334 534 | A | | 8/1999 |
| KR | 2003-0039355 | A | * | 4/2003 |
| WO | WO-2006/079426 | A1 | | 8/2006 |

OTHER PUBLICATIONS

UK Intellectual Property Office Search Report, dated Apr. 2, 2008, issued in connection with counterpart British Application No. 0801334.4.

* cited by examiner

APPARATUS IN SPINNING PREPARATION FOR SEPARATING FOREIGN OBJECTS AT A HIGH-SPEED ROLL FOR OPENING OR DOFFING FIBRE MATERIAL

CROSS REFERENCE TO RELATED APPLICATION

This application claims priority from German Patent Application No. 10 2007 005 047.1 dated Jan. 26, 2007, the entire disclosure of which is incorporated herein by reference.

BACKGROUND OF THE INVENTION

The invention relates to an apparatus in spinning preparation for separating foreign objects at a high-speed roll for opening or doffing fibre material, for example, cotton, synthetic fibres or the like.

It is known to provide at least one device for separating the foreign objects associated with the clothed face of the opening roll or doffer roll, which device comprises an arrangement for producing a current of blast air that flows in the direction onto the clothed face and generates an air stream that detaches the foreign objects from the clothed face and carries the foreign objects away, the arrangement comprising a plurality of blast nozzles that are arranged across the width of the opening roll or doffer roll and are connected to a compressed air pipe and to valves.

In the case of a known apparatus (DE-A-196 45 844), two slow-speed feed rolls are associated with the opening roll laterally and horizontally and feed the fibre material to the opening roll. To keep the evelope of co-rotating air on the opening roll, guide plates are provided. At the lower end of the opening roll there is an arrangement (sensors) for optical detection of foreign particles in the fibre tufts, which is located in a collecting area for separated particles. Between the guide plate and a blade there is an opening though which a current of blast air is directed obliquely from below briefly onto that area of the roll surface where the fibre tufts contain unwanted foreign particles. In this way, the contaminated fibre tufts are blown off the roll surface and then carried away. The drawback of this apparatus is the considerable space requirement, which is caused inter alia by the blowing direction of the blast air source (air nozzles) in the area beneath the opening roll. In addition, it is inconvenient that the blast air source and the valves are located freely in the waste collecting area, which leads to considerable interference to operation, interruptions and the like. Another disadvantage is that the air nozzles with the magnetic valves are arranged separately across the width of the roll. The air jet of each individual air nozzle is therefore directed either tangentially, or slightly away from this tangent, away from the opening roll. A consistent quality of separation and a rapid adjustment when the processed fibre material is changed to one with different proportions of foreign objects is not possible with this apparatus.

SUMMARY OF THE INVENTION

It is an aim of the invention to produce an apparatus of the kind described initially that avoids or mitigates the said disadvantages and in particular permits in a structurally simple manner a consistent quality of separation, namely, a reduction in the proportion of good fibres in the waste, and allows a rapid re-setting of the action of the blast air current.

The invention provides an apparatus in a spinning preparation installation, having:

a roller for opening or doffing fibre material; and an arrangement for separating foreign objects from said fibre material, having a plurality of air nozzles arranged in a direction across the width of the conveying equipment for directing a blast of air towards the roller for generating a flow of air that detaches and removes the foreign objects from the fibre material on the roller surface, the air nozzles being connected to a source of compressed air;

wherein the separation arrangement comprises a bar member for mounting the air nozzles and the outlet of the air nozzles is displaceable in relation to the surface of the roller.

Because a blast nozzle bar is provided for mounting the blast nozzles, by adjusting the blast nozzle bar, for example, by rotating it about its longitudinal axis or displacing it, the outlet of the blast nozzles is locally shifted and hence the effective direction of the blast air in relation to the opening roll can be altered in a simple manner. This enables a consistent quality of separation to be achieved. In addition, for example, upon changeover of the type of fibre material being processed, an especially quick re-setting of the effective direction of the blast air current can be effected. Thus, during foreign particle separation the effective direction of the blast air is adjustable, the result being that the proportion of good fibres in the waste can likewise be influenced. In accordance with the invention an adjustable quality of separation is achieved.

The blast nozzle bar is preferably made from an aluminium extruded profile, in which the valve inserts are integrated. A plurality of valves, lying side by side close together, is therefore made possible over the width of the conveying equipment and at the same time the storage volume of the blast nozzle bar is increased, for example, doubled. The option of being able to integrate more valves and blast nozzles in the blast nozzle bar substantially reduces the proportion of good fibres in the waste. The apparatus according to the invention provides inter alia the following advantages:

- Relatively small installation space, hence improved accessibility
- Larger air volume in the blast bar
- Integration of more than 32 valves across the working width (LGW) of the machine is possible
- Fewer good fibres in the waste
- Blast bar adjustable using pivot point and eccentric, waste quality thus adjustable
- Simpler and quicker servicing possible
- Not susceptible to dirt deposits
- Nozzle positions relative to one another accurate due to mechanical machining in the support profile member.

In certain embodiments, the bar is a housing with wall elements. Advantageously, the interior of the housing is hollow. For example, the housing may comprise a hollow profile with profile walls. The housing may be produced by non-cutting shaping, for example, by extrusion moulding. The hollow profile may, for example, be produced by cutting to length, e.g. severing, a semi-finished extruded part. The air nozzles are advantageously connected to a common source of compressed air, for example, a compressed air pipe. The compressed air pipe may be arranged in the interior of the housing. In one embodiment, a hollow space within the housing is arranged to constitute the compressed air pipe. In some embodiments, the nozzles are arranged in the interior of the housing.

The air nozzles are advantageously associated with valves for controlling the supply of air from the source of compressed air, for example, compressed air pipe. In some embodiments, the valves, in particular magnetic valves, are arranged in the interior of the housing. In other embodiments, the nozzles are arranged on an outer wall of the housing. In that case, the valves, in particular magnetic valves, are advantageously arranged on an outer wall of the housing.

Advantageously, the bar is arranged at a distance from the opener roll or doffer roll. Advantageously, the longitudinal axis of the bar is arranged axially parallel to the opening roll or doffer roll. Advantageously, the longitudinal axis of the bar extends parallel to the clothed face of the opening roll or doffer roll. The blast air current may be an air jet. The blast air current may be directed substantially tangentially to the surface of the clothed roll. Instead, the blast air current may be directed at least partially onto the clothed face, or may be directed at least partially slightly away from the tangent outwards. Preferably, the effective direction of the blast air current is adjustable in relation to the clothed roll. In certain preferred embodiments, in order to adjust the direction of the blast of air, the bar with the nozzles is rotatable or pivotable about a pivot point. Advantageously, the bar with the nozzles is rotatable or pivotable about its longitudinal axis. In certain preferred embodiments, a driven eccentric or the like is provided for the rotary or pivoting movement. Advantageously, the bar with the nozzles is radially displaceable, e.g. slidable in relation to the clothed roll. As well or instead, the bar with the nozzles is advantageously displaceable, e.g. slidable, axially parallel in relation to the clothed roll. Advantageously, an adjusting device is associated with the device for local displacement.

A sensor device for detecting foreign objects is preferably present. For example, an optical sensor system may be arranged upstream of the separating device. In certain preferred embodiments, an optical sensor system for detecting the foreign objects, e.g. foreign fibres, trash and the like, is associated with the opening roll or doffer roll. Advantageously, the sensor system is connected via an electronic control and regulating means to the downstream device for separating the foreign objects. Where present, the valves, for example, magnetic valves, are connected to the electronic control and regulating means. Advantageously, the adjusting device for the displacement is connected to the electronic control and regulating means. The apparatus of the invention advantageously provides for the foreign objects to be selectively blown out. Advantageously, the nozzles are activatable at locations across the width of the clothed roll corresponding to those upstream locations at which the sensor system has detected foreign objects. Advantageously, a momentary blast air current is activatable. Advantageously, the outlet of all blast nozzles is locally displaceable. Advantageously, the outlet of the blast nozzles is simultaneously displaceable. Advantageously, the outlet of the blast nozzles is uniformly displaceable. Advantageously, the outlet of the blast nozzle is displaceable by the same amount. Advantageously, openings for the passage of blast air currents are provided in a wall element of the housing.

The invention also provides an apparatus in spinning mill preparation for separating foreign objects at a high-speed roll for opening or doffing fibre material, for example, cotton, synthetic fibres or the like, in which at least one device for separating the foreign objects is associated with the clothed face of the opening roll or doffer roll, which device comprises an arrangement for producing a current of blast air that flows in the direction onto the clothed face and generates an air flow that detaches the foreign objects from the clothed face and carries the foreign objects away, wherein the arrangement comprises a plurality of blast nozzles that are arranged across the width of the opening roll or doffer roll and are connected to a compressed air pipe and to valves, and in which a bar for mounting the blast nozzles is present and the outlet of the blast nozzles is locally displaceable in relation to the clothed face of the opening roll or doffer roll.

DETAILED DESCRIPTION OF CERTAIN PREFERRED EMBODIMENTS

Figure 1:
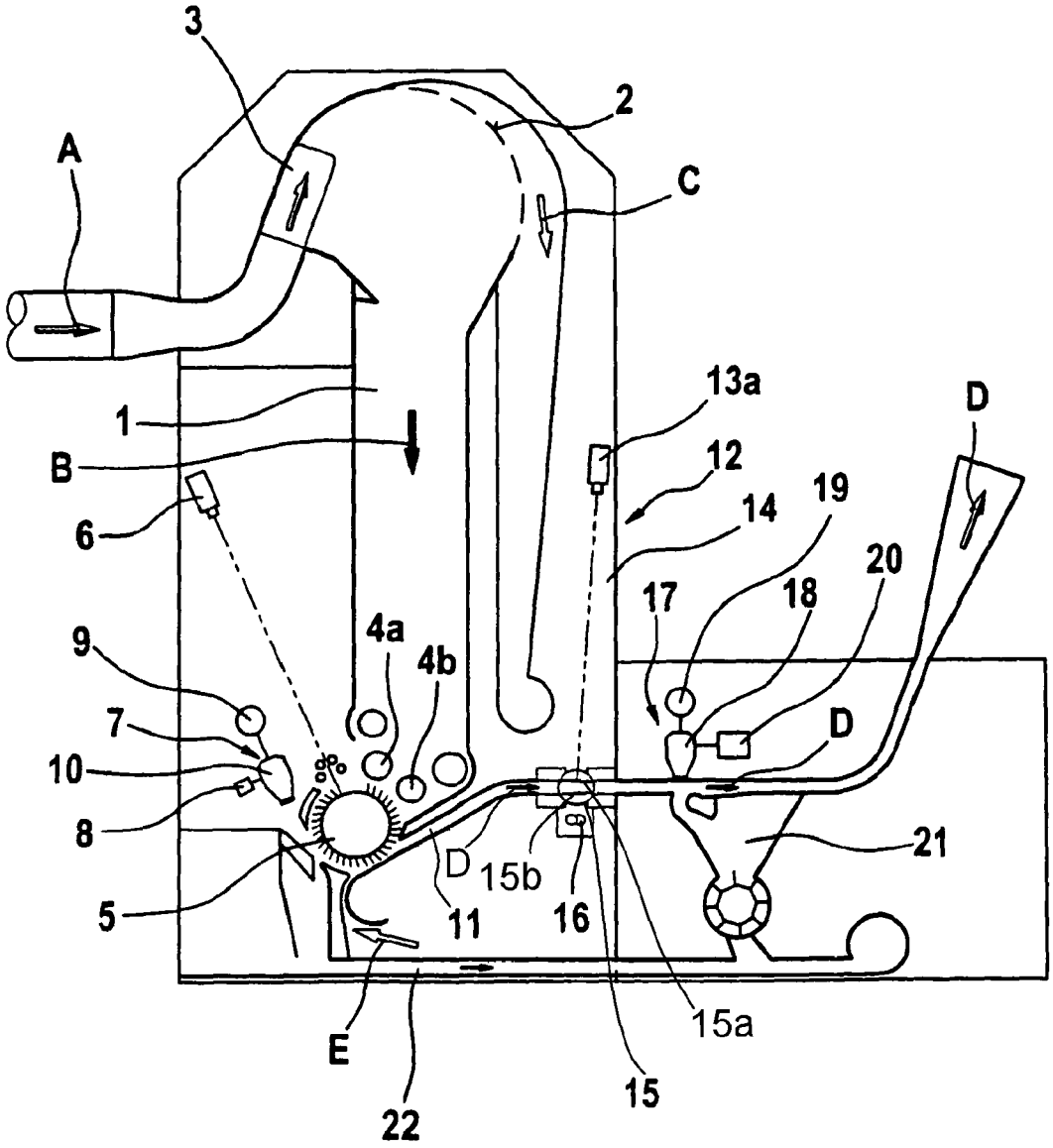
FIG. 1 is a schematic side view of a foreign particle detection and separation device, having two arrangements of the apparatus according to the invention.

Referring to FIG. 1, in an apparatus for detecting and separating foreign objects, e.g. the foreign part separator SECUROMAT SP-F2, made by Trützschler GmbH & Co. K.G. of Mönchengladbach, Germany, the upper inlet opening of a feed chute 1 has associated with it an arrangement for the pneumatic supply of a fibre-air flow A, which comprises a fibre material transport fan (not shown), a stationary air-permeable surface 2 for separation (ejection) of the fibre material B from air C with air extraction, and an air flow guide means 3 with movable elements; the fibre material present in the air flow is guided reversibly forwards and backwards transversely over the air-permeable surface 2 and, following impact, the fibre material falls substantially as a result of gravity from the air-permeable surface 2 and enters the feed chute 1 downwards. The slow-speed rolls 4*a*, 4*b* have a dual function: they serve as take-off rolls for removing the fibre material B out of the feed chute 1 and at the same time as feed rolls for supplying the fibre material B to a high-speed opening roll 5. The opening roll 5 in the example is in the form of a needle roll. A pin or clothed roll (not illustrated) can also be used as the opening roll. The solid arrows represent fibre material, the empty arrows represent air and the half-filled arrows represent an air current with fibres.

An optical sensor system 6, for example, a line-scan camera 6 (CCD camera) with an electronic evaluating device for the detection of foreign objects, especially with brightness and/or colour variations, is associated with the whole width of the surface area of the opening roll 5. The sensor system 6 is connected by way of an electronic control and regulating device 53 (see FIG. 7) to an arrangement 7 for separating the foreign objects 52 (see FIG. 6). The arrangement 7 is capable of generating a short blast air current, which travels towards the clothed face and creates a suction airflow, which detaches the foreign objects together with a few fibres from the clothed face and carries them away into a channel 22.

The optical sensor system 6 with the camera, for example, a colour line-scan camera, is arranged obliquely above the opening roll 5 close to the outer wall of the feed chute 1. This produces a compact, space-saving construction. The colour line-scan camera 6 is directed towards the clothing of the opening roll 5 and is able to detect coloured foreign objects, for example, red fibres, in the fibre material. The camera 6 covers the entire region across the width of the opening roll 5, e.g. 1600 mm. The opening roll 5 rotates anticlockwise in the direction of the curved arrow. Downstream of the optical sensor system 6 in the direction of rotation is the arrangement 10 for producing a blast air current, the nozzles of which are oriented towards the clothed face of the opening roll 5 in such a way that a short, sudden jet of air flows tangentially in relation to the clothed face. The sensor system 6 is connected by way of an evaluating device and the electronic control and regulating device 53 to the arrangement 7, with which there is associated a valve control means 8. When the camera 6 has detected a foreign object in the fibre material on the clothed face on the basis of comparative and desired values, using the valve control means 8 a short air burst is expelled at high speed in relation to the clothing and tears the foreign object together with a few fibres out of the fibre covering on the clothing by a suction air current, and subsequently carries them away through a channel 22 under suction. The reference numeral 9 denotes a compressed air pipe.

A blast air current L flows through a channel 56 approximately tangentially to the opening roll 5, detaches the fibre covering (good fibres) from the clothing and flows away as a fibre-air flow D through a fibre transport conduit 11.

A further apparatus 12 is associated with the pneumatic fibre transport conduit 11. The apparatus 12 is suitable for detecting foreign objects of any kind, for example, pieces of cloth, tapes, string, pieces of sheeting and the like in the fibre material. According to an advantageous construction, the apparatus 12 is used to detect foreign particles of plastics material, such as polypropylene bands, fabric and sheeting and the like in or between fibre tufts, for example, of cotton and/or synthetic fibres.

In the case of the apparatus 12 for detecting foreign objects, the fibre material is transported in an airflow (fibre-air flow D) through the pneumatic fibre transport conduit 11, which is connected to a suction source (not illustrated). As the optical sensor system, two cameras 13*a*, 13*b*, for example, diode array cameras with polarisation filters, are arranged in a housing 14 above the fibre transport conduit 11 across the machine width, which is, for example, 1600 mm. Beneath the cameras 13*a*, 13*b* (only camera 13*a* is shown), the wall surfaces of the fibre transport conduit 11 have two transparent regions in the form of two parallel and opposite glass panes 15*a*, 15*b* (glass windows), which form a glass channel 15. Lighting equipment 16 is provided beneath the fibre transport conduit 11. Downstream of the glass channel 15, a blowing-out device 17 for separation of the foreign objects detected by the apparatus 12 is associated with the fibre transport conduit 11. Downstream of the blowing-out device 17, the fibre-air flow D is sucked through the fibre transport conduit 11 and fed onwards for further processing.

In operation, the camera 13*a* detects the fibre-air flow D through the glass pane 15*a*. Here, the glass pane 15*a* projects into the fibre-air flow D in such a way that the fibre-air flow D meets the glass pane 15*a* and flows along and in pressure-applying contact with the glass pane 15*a*. Through the movement of the fibre-air flow D, on the one hand unwanted deposits on the glass pane 15*a* are largely or completely avoided and, if slight deposits do occur, they are wiped off the inner surface of the glass pane 15*a* by the fibre-air flow D and carried away through the channel 11. The fibre-air flow D has a similar effect on the inner surface of the glass pane 15*b*.

If unwanted foreign objects are detected in the fibre-air flow D by the apparatus 12, the blowing-out device 17 is activated and blows the foreign objects 52 into a suction channel 21. The blowing-out device 17 is arranged downstream of the optical sensor system 12, and its nozzles are oriented towards the inner space of the conveyor pipe 11 such that a short, sudden air jet flows onto the detected foreign particle. The sensor system 12 is connected by way of an evaluating device and the electronic control and regulating device 53 to the device 17, with which there is associated a valve control means 20. When the camera 13 has detected a foreign object in the fibre material on the basis of comparative and desired values, using the valve control means 20 a short air burst is expelled at high speed and blows the foreign object together with a few fibres out of the fibre-air flow D, and subsequently carries them away through a channel 21 under suction. The reference numeral 19 denotes a compressed air pipe.

Figure 2:
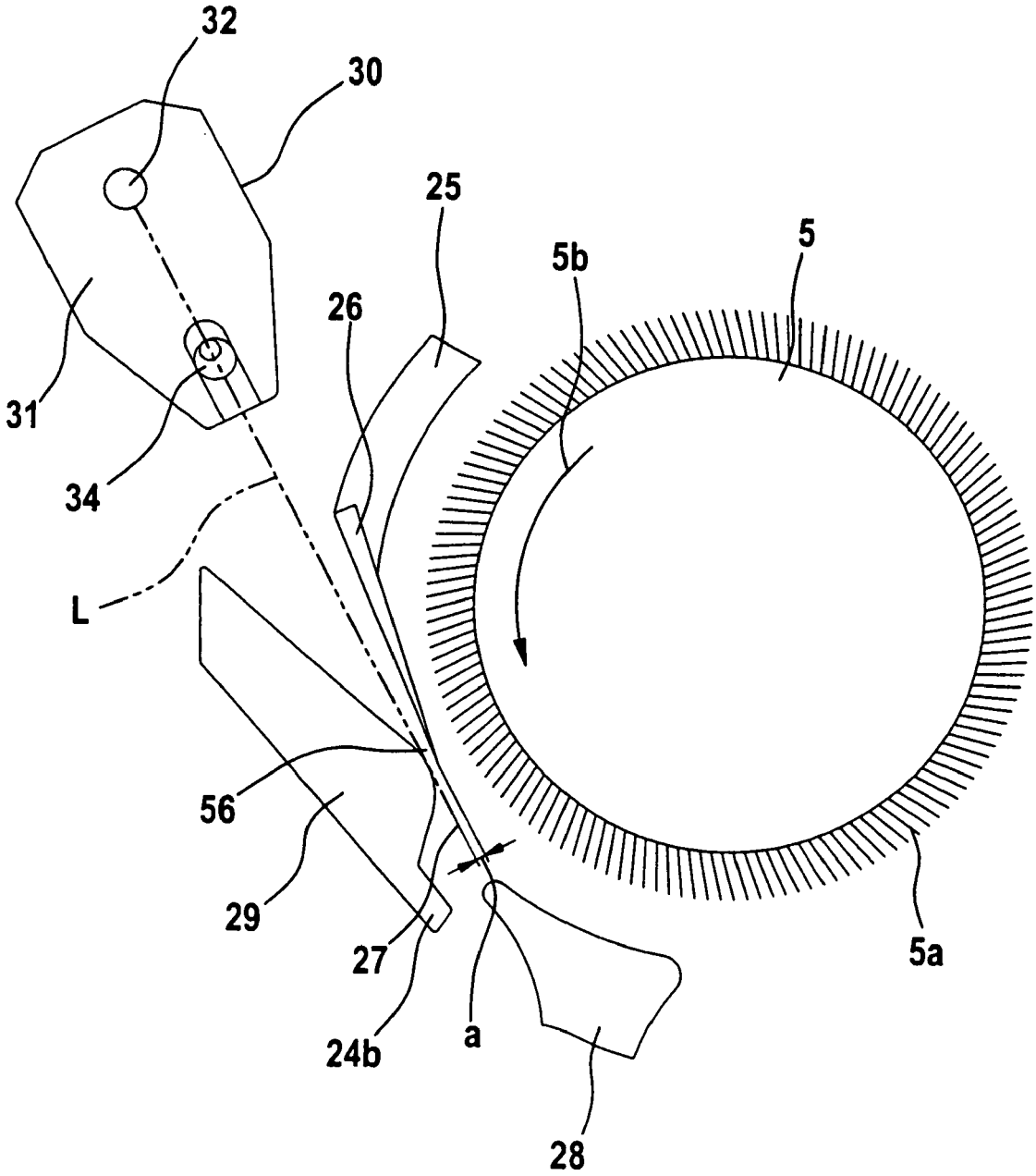
FIG. 2 is a side view of the opening roll of the apparatus of FIG. 1 and associated cover elements and blast nozzle bar.

As shown in FIG. 2, associated with and lying opposite the clothed face 5*a* of the opening roll 5 are, viewed in the direction of rotation 5*b*, a cover 25, a covering air guide element 26, an opening 27 and a cover 28. The air guide element 26 and a guide surface of an opposite guide element 29 are arranged tapering conically towards one another, forming a channel 56, and are spaced a distance a from one another at a constriction, through which the compressed air flow L passes in such a way that it flows a short distance away from the clothed face. This creates a suction air flow in the manner of a water jet pump, which momentarily and locally tears a small amount of fibre together with the foreign objects out of the fibre covering on the clothed face. The guide element 29 has a rounded projection 24*b* and a further guide face, which together with the opposite cover 28 forms a channel through which the air current flows away.

Figure 2A:
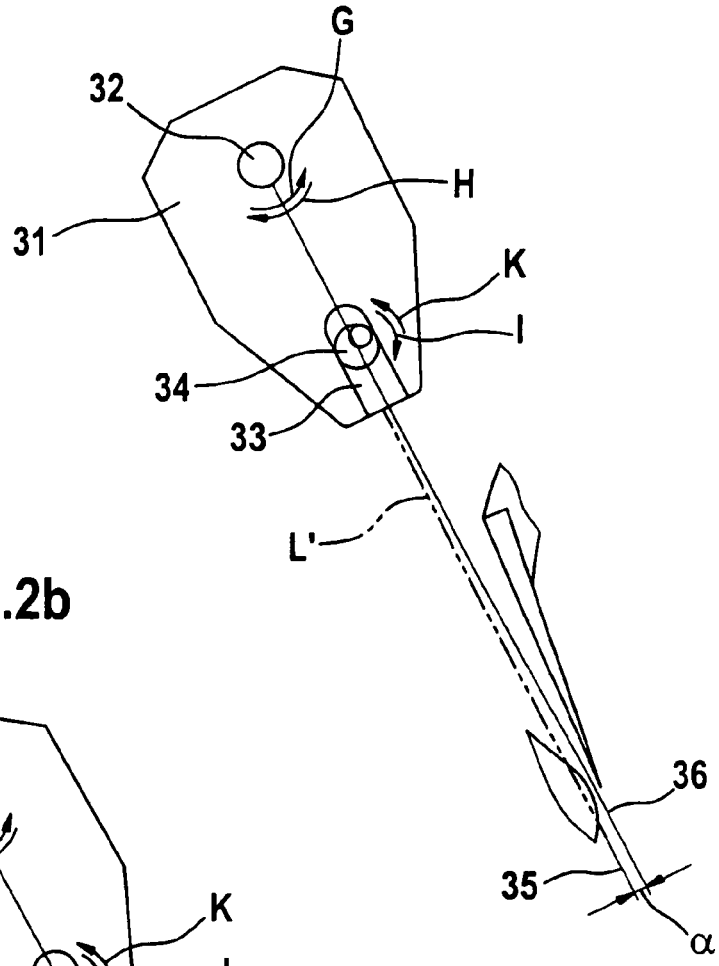
FIGS. 2*a*, 2*b* are side views of a blast nozzle bar with a pivot joint in the inwardly rotated position (FIG. 2*a*) and in the outwardly rotated position (FIG. 2*b*) in relation to the clothed face of the opening roll.
Figure 2B:
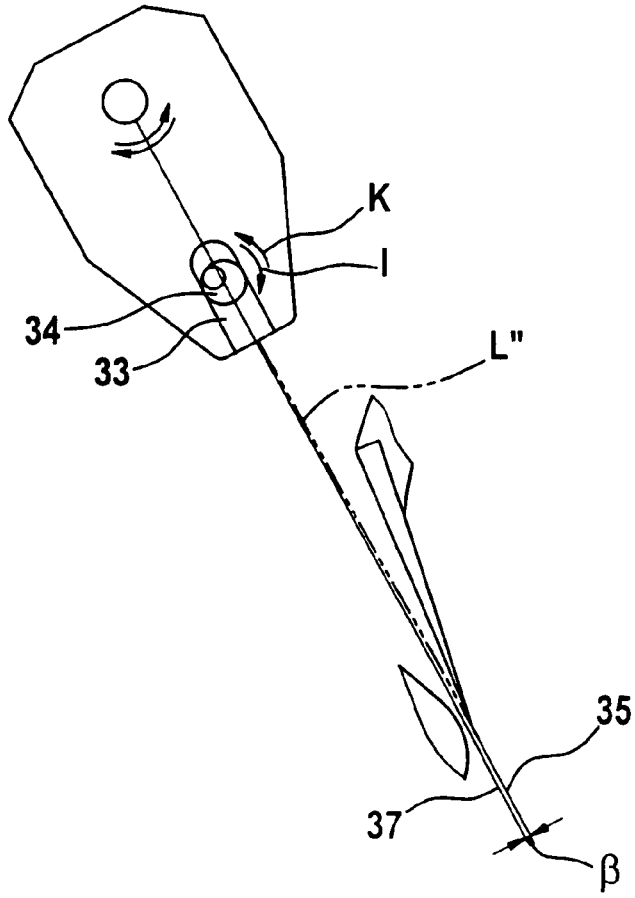

The nozzle bar 30 comprises a housing 31, which is pivotable in and out about a fixed pivot bearing 32 in the direction of the arrows G, H. As shown in FIGS. 2*a* and 2*b*, in its edge region remote from the pivot bearing 32 the housing 31 has an elongate opening 33, within which an eccentric 34 that is rotatable in the direction of the arrows I, K and touches the inner wall surface of the opening 33 is arranged. By rotation of the eccentric 34, the housing 31 is rotated about the pivot bearing 32 so that the outlet 38 of the blast nozzles (see FIG. 5), and hence the direction of the blast air current E in relation to the clothed face 5*a* of the opening roll 5, is locally displaced. Starting from a normal direction 35 denoted by a dot-dash line, the direction 36 of the blast air current L' shown in FIG. 2*a* is moved closer to the clothed face 5*a*; the normal direction 35 and the direction 36 form an acute angle $\alpha$. According to FIG. 2*b*, the direction 37 of the blast air current L" in relation to the normal direction 35 is moved further away from the clothed face 5*a*; the normal direction 35 and the direction 37 form an acute angle $\beta$.

Figure 3:
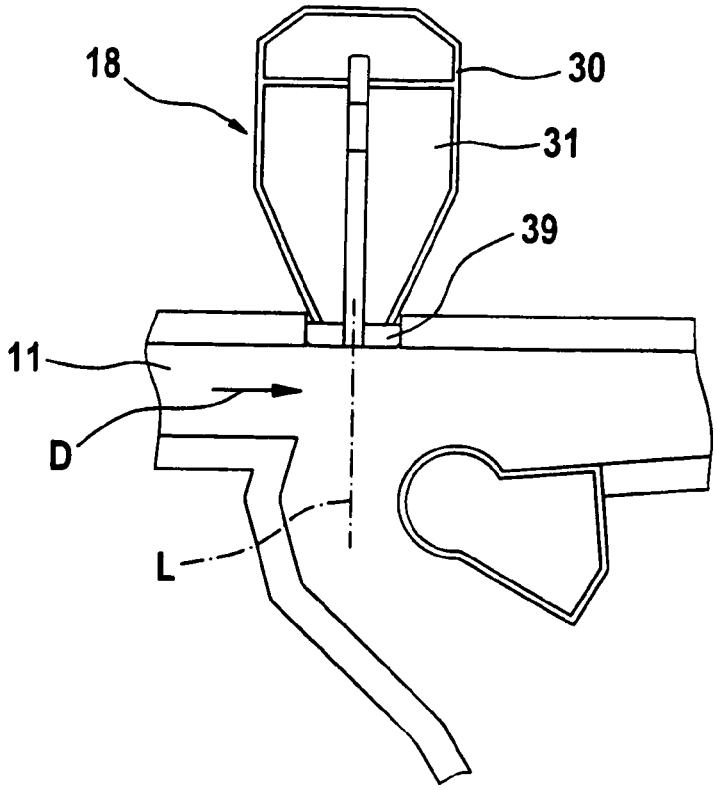
FIG. 3 is a side view of the blast nozzle bar on a fibre tuft feed line.

Corresponding to FIG. 3, the device 18 for generating a blast air current is associated with the pneumatic conveyor conduit 11. In relation to the conveyor conduit 11, the outlet of the housing 31 of the blast nozzle bar 30 is arranged in a continuous wall opening, which extends transversely across the width of the conveyor conduit 11. A nozzle plate 39 is arranged in front of the outlet of the housing 31 with the continuous blast air openings 38 and, as shown in FIG. 4, has a greater number of, for example, about two or three times as many, nozzle openings 40 compared with the number of blast air openings 38.

Figure 4:
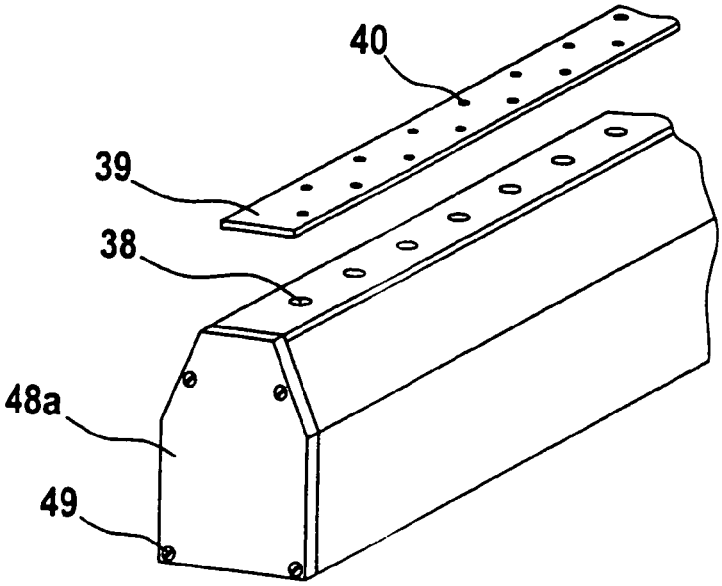
FIG. 4 is a perspective view of the blast nozzle bar with nozzle plate.

FIG. 4 shows one arrangement suitable for use in a nozzle bar according to the invention. The housing 31 is formed in part by a hollow profile. The two open end faces of the hollow profile are closable by a closure plate 48*a* and 48*b* respectively. For that purpose, screws 49 (only one screw is indicated) are provided, which engage right through bores in the closure plates 48*a*, 48*b* into threaded bores provided on the end faces of the hollow profile 31 in the profile walls 31*b*. The closure plates 48*a*, 48*b* consist of aluminium in an exemplary embodiment. The closure plates 48*a*, 48*b* must be secured with firm contact pressure to the hollow profile 31 to ensure an airtight seal of the blast air channel (hollow space 31*a*). A through opening 50 (bore) is provided in the closure plate 48*b*, to which a compressed air pipe 51 (see FIG. 6) leading to a source of compressed air (not illustrated) is connected.

Figure 5:
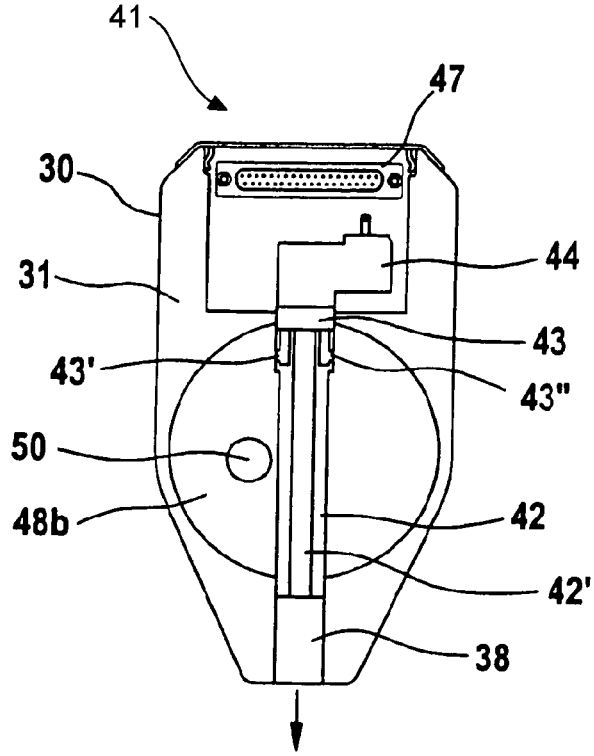
FIG. 5 is a schematic cross-section through the blast nozzle bar with nozzle insert, magnetic valve and magnetic valve control means.
Figure 5A:
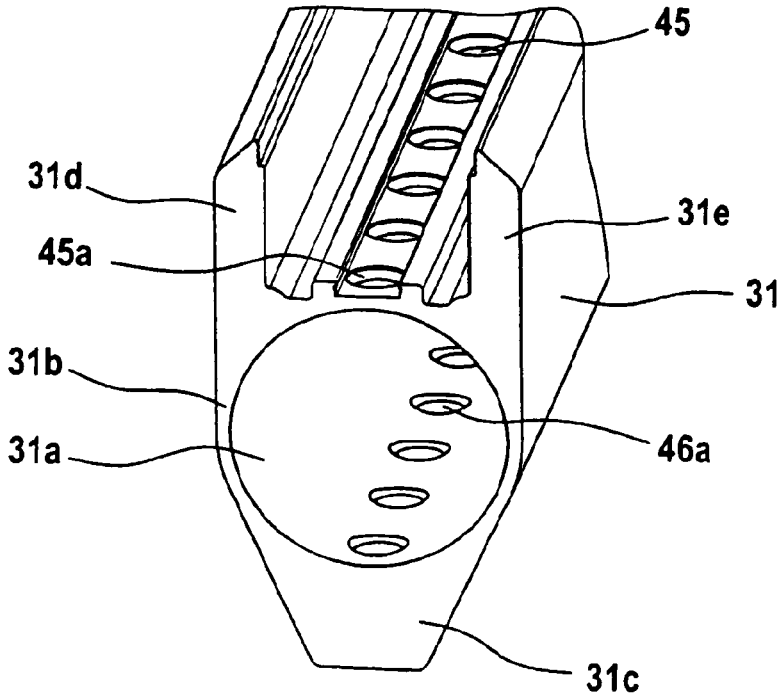
FIG. 5*a* is a perspective view of part of the blast nozzle bar for mounting the blast nozzles.

In a preferred embodiment shown in FIG. 5, the blast nozzle bar 30 comprises a housing 31 in which a plurality of blast nozzles 41 is integrated. The housing 31 shown in FIG. 5*a* is in the form of an extruded hollow profile, e.g. of an Al—Mg alloy, which encloses a closed hollow space 31*a* that serves as a compressed air duct for the blast nozzles 41. The inner space of the hollow space 31*a* has a circular cross-sectional shape. The hollow profile is produced by cutting, e.g. sawing, laser cutting, a length from a semi-finished, extruded hollow profile (not illustrated). The hollow profile in the exemplary embodiment is in one piece. The profile wall is denoted by the reference numeral 31*b* and has different wall thicknesses. Looking at the cross-section shown in FIGS. 5 and 5*a*, the profile wall 31*b* in the region below the hollow space 31*a* is in the form of a neck 31*c* that extends over the entire length, and in the region laterally above the hollow space 31*a* two parallel opposing rails 31*d*, 31*e* are provided, which likewise extend over the entire length. Vertically above the elongate centre line of the hollow space 31*a*, a plurality of through bores 45*a* to 45n is provided parallel to the centre line and closely side by side, their number corresponding to the number of blast nozzles 41, e.g. 64 blast nozzles. A plurality of through bores 46*a* to 46n, the number of which likewise corresponds to the number of blast nozzles 41, are arranged closely side by side in the profile wall 31*b* and in the neck 31*c* vertically below the elongate centre line. The two rows of bores 45*a* to 45n and 46*a* to 46n are aligned parallel to one another. The centre lines of the opposing bores 45*a* to 45n and 46*a* to 46n are aligned with one another, i.e. the opposing bores 45*a* to 45n and 46*a* to 46n are arranged coaxial to one another.

In the embodiment of FIG. 5, the blast nozzles 41 each comprise a nozzle insert 42, a magnetic valve 43 and a magnetic valve control means 44. Each valve insert 42 with a magnetic valve 43 is pushed through two coaxially opposite bores 45*a* to 45n and 46*a* to 46n such that the nozzle insert 42 open at one end engages in a bore 46*a* to 46n of the neck 31*c*, and the magnetic valve 43 at the other end of the nozzle insert 42 engages through a bore 45*a* to 45n in the profile wall 31*b*. Here, one part of the magnetic valve 43, which is arranged in the hollow space 31*a* and projects inwards beyond the profile wall 31*b*, has two inlet openings 43', 43" for blast air (compressed air). A respective magnetic valve control means 44 is mounted at the other region of the magnetic valve 43, which is arranged outside the hollow space 31*a* in the profile wall 31*b*. The magnetic valve control means 44*a* to 44n are arranged between the rails 31*d* and 31*e*. Between the rails 31*d* and 31*e* and above the magnetic valves 43*a* to 43n there is an elongate duct 47 for the electrical leads to which the magnetic valve control means 44*a* to 44n are connected. The outer walls of the nozzle inserts 42*a* to 42n and the valves 43*a* to 43n are hermetically sealed against the inner walls of the bores 45*a* to 45n and 46*a* to 46n. The valve inserts 42 and the magnetic valves 43 are also fixed in position by this measure. The magnetic valves 43*a* to 43n are each fixed to the profile wall using a clamping ring. The components that are used to generate a current of blast air (compressed air duct 31*a*, nozzle inserts 42 to 42n, magnetic valves 43*a* to 43n, magnetic valve control means 44*a* to 44n) are integrated in the manner illustrated in the bar 30 and in the housing 31.

Figure 6:
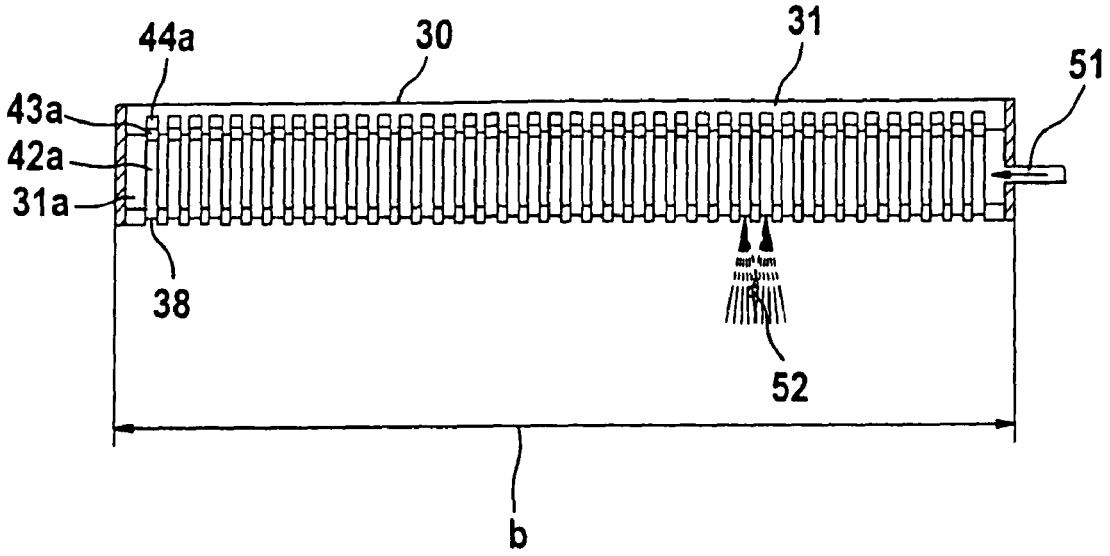
FIG. 6 is a schematic front view in section through the blast nozzle bar.

In a further embodiment shown in FIG. 6, a plurality of blast nozzles 41 arranged side by side across the width b, e.g. 1600 mm, of the conveying equipment is integrated in the blast nozzle bar. The conveying equipment can be an opening roll 5 or a pneumatic conveyor conduit 11. The reference numeral 52 denotes a foreign particle, which is blown out selectively by brief jets of blast air from two adjacent blast air nozzles, and removed. The blast nozzle bar 30 may be as illustrated in, and described with reference to, FIGS. 5 and 5*a*, although any other blast nozzle bar constructed in accordance with the invention may be used.

Figure 7:
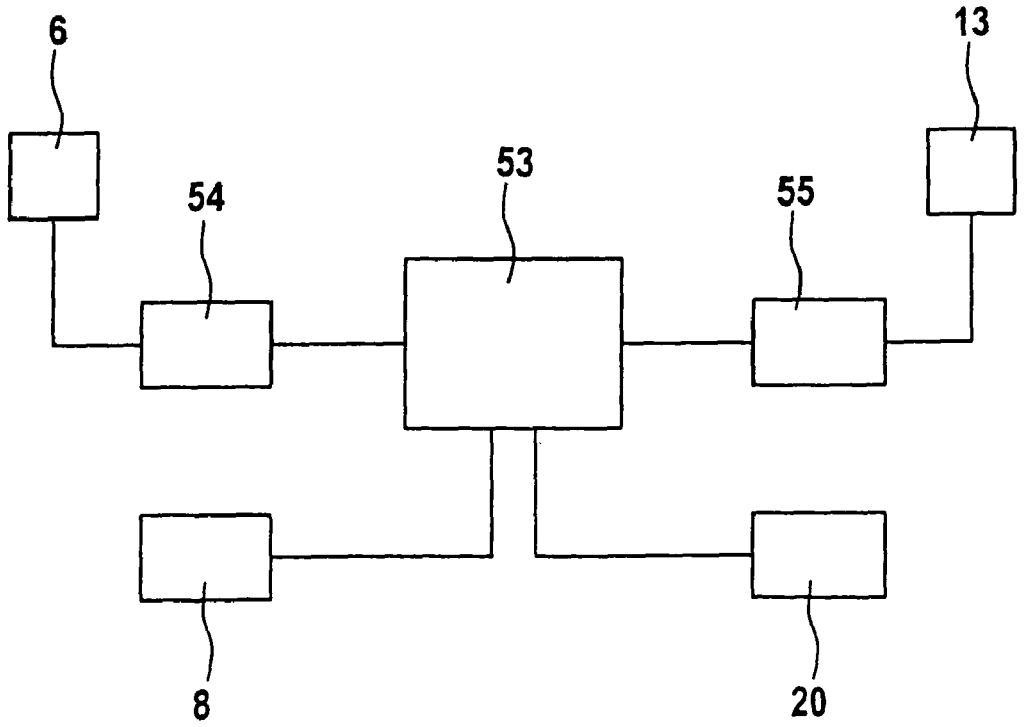
FIG. 7 is a schematic diagram showing an electronic control and regulating device to which two optical sensor systems and two blowing out devices are connected.

In an illustrative control arrangement shown in FIG. 7, the camera 6, an image evaluating device 54 and a valve control means 8 (or that is to say the magnetic control means 44*a* to 44n) for the valves of the blowing out device 10 are connected to an electronic control and regulating device 53. In addition, the cameras 13*a*, 13*b*, an image evaluating device 55 and the valve control means 20 (or that is to say the magnetic valve control means 44*a* to 44n) for the valves of the blowing out device 18 are connected to the electronic control and regulating device 53

For ease of reference, a list of the reference numerals used in the accompanying drawings is given in the Table below. Unless otherwise indicated herein, the same reference numerals are used in a number of the Figures to indicate common features, which do not require separate description in relation to each Figure.

LIST OF REFERENCE NUMERALS

1 Hopper
2 Air-permeable surface
3 Air current guide means
4*a*, 4*b* Rolls
5 Opening roll
5*a* Clothed face
6 Sensor system
7; 17 Device for separating the foreign objects
8; 20 Valve control
9; 19 Compressed air pipe
10; 18 Arrangement for generating a blast air current
11 Fibre transport pipe
12 Device for detecting foreign objects
13*a*, 13*b* Cameras
13 Housing
14 Glass channel
15*a*, 15*b* Glass panes
16 Illuminating means
21 Channel
22 Channel
28 Cover
26 Air guide element
27 Opening
28 Cover
29 Guide element
30 Nozzle bar
31 Housing
31*a* Hollow space
31*b* Profile wall, housing wall

31*c* Neck
31*d* Rail
31*e* Rail
32 Pivot bearing
33 Opening
34 Eccentric
35 Normal direction
36 Direction of the blast air current
37 Direction of the blast air current
38 Blast air openings
39 Nozzle plate
40 Nozzle openings
41 Blast nozzles
42; 42*a* to 42n Nozzle inserts
42' Nozzle duct
42" Outlet of nozzle duct
43; 43*a* to 43n Valve, magnetic valve
43'; 443" Air inlet openings
44; 44*a* to 44n Magnetic valve control
45; 45*a* to 45n Bores
46; 46*a* to 46n Bores
47 Duct
48*a*, 48*b* Closure plates
49 Screw
50 Opening (bore)
51 Compressed air connection line
52 Foreign particle
53 Electronic control and regulating device
54 Image evaluating device
55 Image evaluation
56 Channel Although the foregoing invention has been described in detail by way of illustration and example for purposes of understanding, it will be obvious that changes and modifications may be practised within the scope of the appended claims.

What is claimed is:

1. An apparatus in a spinning preparation installation, comprising:

a roller for opening or doffing fibre material; and a separation arrangement for separating foreign objects from said fibre material, having a plurality of air nozzles arranged in a direction across a width of conveying equipment for directing a blast of air towards the roller for generating a flow of air that detaches and removes the foreign objects from the fibre material on the roller surface, the air nozzles being connected to a source of compressed air; wherein the separation arrangement comprises a bar member for mounting the air nozzles and the outlet of the air nozzles is displaceable in relation to the surface of the roller.

2. An apparatus according to claim 1, in which the bar member is a housing with wall elements.

3. An apparatus according to claim 2, in which the interior of the housing is hollow.

4. An apparatus according to claim 2, in which the housing comprises a hollow profile with profile walls.

5. An apparatus according to claim 2, in which a compressed air pipe for supplying compressed air to the air nozzles is arranged in the interior of the housing.

6. An apparatus according to claim 1, in which the longitudinal axis of the bar is arranged spaced from and axially parallel to the roller.

7. An apparatus according to claim 1, in which the blast of air is directed generally towards the surface of the roller.

8. An apparatus according to claim 1, in which the effective direction of the blast of air is adjustable in relation to the roller surface.

9. An apparatus according to claim 1, in which the bar member with the nozzles is rotatable or pivotable about a pivot point.

10. An apparatus according to claim 1, in which the bar member with the nozzles is rotatable or pivotable about its longitudinal axis.

11. An apparatus according to claim 9, in which a driven eccentric is provided for the rotary or pivoting movement.

12. An apparatus according to claim 1, in which the bar member with the nozzles is radially displaceable in relation to the roller.

13. An apparatus according to claim 1, in which the bar member is so mounted that it is slidably displaceable in the radial direction.

14. An apparatus according to claim 1, in which the bar member is so mounted that it is slidably displaceable axially parallel in relation to the roller.

15. An apparatus according to claim 8, in which the effective direction of the blast of air is adjustable by an adjusting device associated with a device for effecting positional displacement of the air nozzle outlets.

16. An apparatus according to claim 1, in which an optical sensor system for detecting foreign objects is provided, arranged upstream of the separating arrangement or in association with the roller.

17. An apparatus according to claim 16, in which the sensor system is connected via an electronic control and regulating means to the downstream device for separating the foreign objects.

18. An apparatus according to claim 17, in which there are further connected to the electronic control and regulating device magnetic valves for controlling the air supply to the nozzles and/or an adjusting device for displacement of the bar member.

19. An apparatus according to claim 16, in which the nozzles are activatable at locations across the width of the roller corresponding to those upstream locations at which the sensor system has detected foreign objects.

20. An apparatus according to claim 1, in which the outlets of all blast nozzles are locally displaceable and/or simultaneously displaceable and/or uniformly displaceable.

21. An apparatus according to claim 1 in which the roller is a high-speed roller having a clothed surface.

22. An apparatus according to claim 1, in which the working width of the roller is approximately 1600 mm and there are more than 32 valves provided across the working width.

* * * * *